US009156569B2

(12) United States Patent
Vassallo et al.

(10) Patent No.: US 9,156,569 B2
(45) Date of Patent: Oct. 13, 2015

(54) PEDIATRIC DOSING DISPENSER

(71) Applicant: Berry Plastics Corporation, Evansville, IN (US)

(72) Inventors: John A Vassallo, Lititz, PA (US); Steven Gift, Lititz, PA (US); W Gordon Beecroft, Leola, PA (US)

(73) Assignee: Berry Plastics Corporation, Evansville, IN (US)

( * ) Notice: Subject to any disclaimer, the term of this patent is extended or adjusted under 35 U.S.C. 154(b) by 311 days.

(21) Appl. No.: 13/722,674

(22) Filed: Dec. 20, 2012

(65) Prior Publication Data

US 2013/0160891 A1 Jun. 27, 2013

Related U.S. Application Data

(60) Provisional application No. 61/578,765, filed on Dec. 21, 2011.

(51) Int. Cl.

| | |
|---|---|
| ***B65D 47/20*** | (2006.01) |
| ***B65B 3/00*** | (2006.01) |
| ***B65D 47/08*** | (2006.01) |

(52) U.S. Cl.

CPC ..... *B65B 3/003* (2013.01); *B65D 47/0804* (2013.01); *B65D 47/2037* (2013.01)

(58) Field of Classification Search

CPC . B65B 3/003; B65D 47/0804; B65D 47/2037

USPC ..... 141/2, 18, 21, 25–27, 369–370, 372, 141/375, 379

See application file for complete search history.

(56) References Cited

U.S. PATENT DOCUMENTS

| | | | | |
|---|---|---|---|---|
| 3,853,157 | A * | 12/1974 | Madaio | 141/2 |
| 4,493,348 | A * | 1/1985 | Lemmons | 141/1 |
| 5,573,516 | A * | 11/1996 | Tyner | 604/249 |
| 5,620,434 | A * | 4/1997 | Brony | 604/406 |
| 5,911,252 | A * | 6/1999 | Cassel | 141/234 |
| 7,077,176 | B2 * | 7/2006 | Py | 141/301 |
| 7,568,509 | B2 * | 8/2009 | Py | 141/301 |
| 8,272,411 | B2 * | 9/2012 | Py | 141/301 |
| 8,459,312 | B2 * | 6/2013 | Manera et al. | 141/27 |
| 2007/0214692 | A1 * | 9/2007 | Ferrara | 40/324 |
| 2011/0168292 | A1 * | 7/2011 | Luzbetak et al. | 141/2 |
| 2012/0103468 | A1 * | 5/2012 | Terwilliger et al. | 141/346 |
| 2012/0103469 | A1 | 5/2012 | Terwilliger et al. | |
| 2012/0103470 | A1 | 5/2012 | Terwilliger et al. | |
| 2012/0104054 | A1 | 5/2012 | Terwilliger et al. | |
| 2013/0180618 | A1 * | 7/2013 | Py | 141/2 |
| 2014/0261860 | A1 * | 9/2014 | Heath et al. | 141/2 |

* cited by examiner

*Primary Examiner* — Nicolas A Arnett
(74) *Attorney, Agent, or Firm* — Barnes & Thornburg LLP

(57) ABSTRACT

A package that is configured to store and dispense fluids. The package includes a container and a dosing dispenser for closing an opening to the container. The dosing dispenser includes a body portion having a syringe receiver and a valve assembly that is configured to permit the flow of fluid from the container to the syringe.

23 Claims, 12 Drawing Sheets

PEDIATRIC DOSING DISPENSER

PRIORITY CLAIM

This application claims priority under 35 U.S.C. §119(e) to U.S. Provisional Application Ser. No. 61/578,765, filed Dec. 21, 2011, which is expressly incorporated by reference herein.

BACKGROUND

The present disclosure relates to dosing dispensers for mounting on the top of bottles, or other containers, and in particular, to a dosing dispenser including a body portion coupled to a container and a flip-top cap coupled to the body portion. More particularly, the present disclosure relates to a dosing dispenser with a syringe receiver configured to accept a syringe to allow a user to dose liquid into the syringe.

SUMMARY

A package, in accordance with the present disclosure, is configured to store and dispense fluids. The package includes a container and a dosing dispenser for closing an opening to the container.

In illustrative embodiments, the dosing dispenser includes a body portion and a flip-top cap pivotably coupled to the body portion and movable to a closed position on the body portion to conceal a syringe receiver. The dosing dispenser is provided with a valve assembly that is configured to permit the flow of fluid through the syringe receiver when a portion of the syringe is inserted into the syringe receiver and to prevent the flow of fluid when the syringe is removed. The valve assembly limits the unwanted discharge of fluid from the dosing dispenser when a syringe is not present.

In illustrative embodiments, the valve assembly includes a valve having a series of flexible connectors used to bias the valve toward the syringe receiver to create a seal between the valve and syringe receiver. Inserting the fluid-transfer tip of the syringe into the syringe receiver causes downward movement of the valve to break the seal between the valve and the syringe receiver to permit fluid flow. The valve is formed to include a plurality of radial flow channels that provide conduits to permit fluid flow from the container to the syringe.

In illustrative embodiments, the valve assembly may include a valve and a cantilevered arm that permits the valve to move from a sealing position against the syringe receiver to a second position that allows liquid to flow from the container into the syringe. Retainers are provided to retain the cantilever arm in an in-use position. Insertion of fluid-transfer tip of the syringe into the syringe receiver causes the cantilever arm to flex downwardly so that the seal can be broken between the valve and the syringe receiver to permit fluid flow.

Additional features of the disclosure will become apparent to those skilled in the art upon consideration of the following detail description of illustrative embodiments exemplify the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
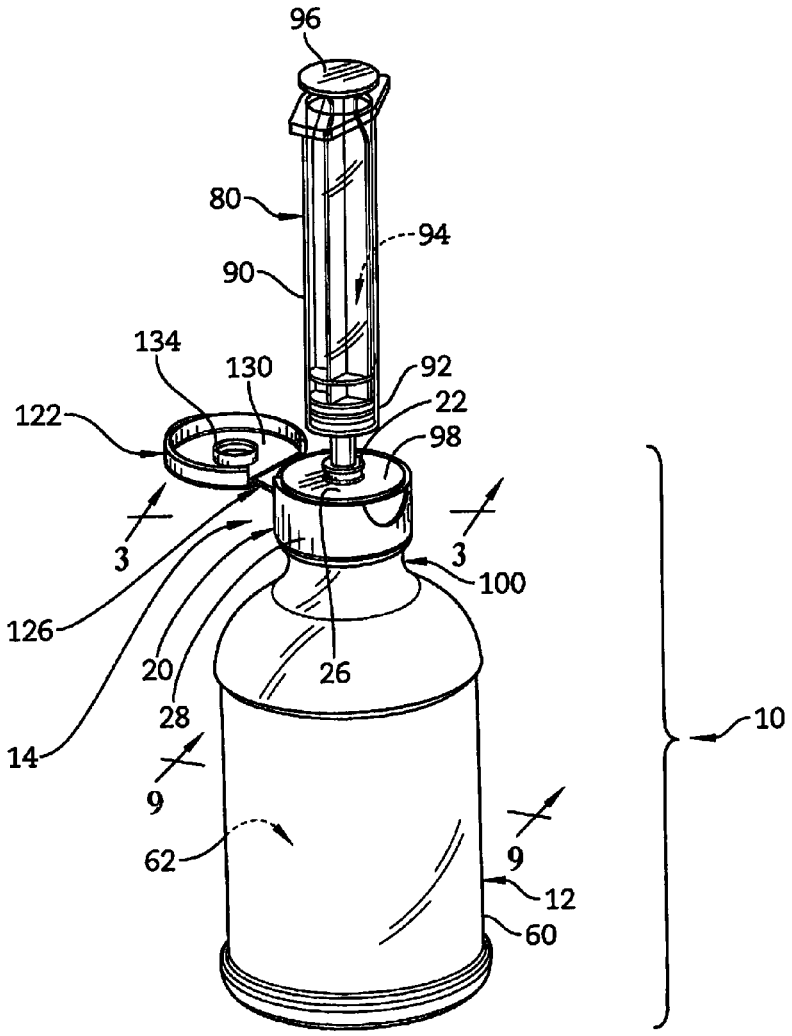
FIG. 1 is a perspective view of a package and a syringe in accordance with the present disclosure, showing a container and a dosing dispenser coupled to the container, the dosing dispenser including a body portion coupled to the container and a flip-top cap shown pivoted to an opened position to expose a syringe receiver adapted to receive a fluid-transfer tip of the syringe to permit the dosing of fluid from the container to the syringe as suggested in FIGS. 9-11.
Figure 3:
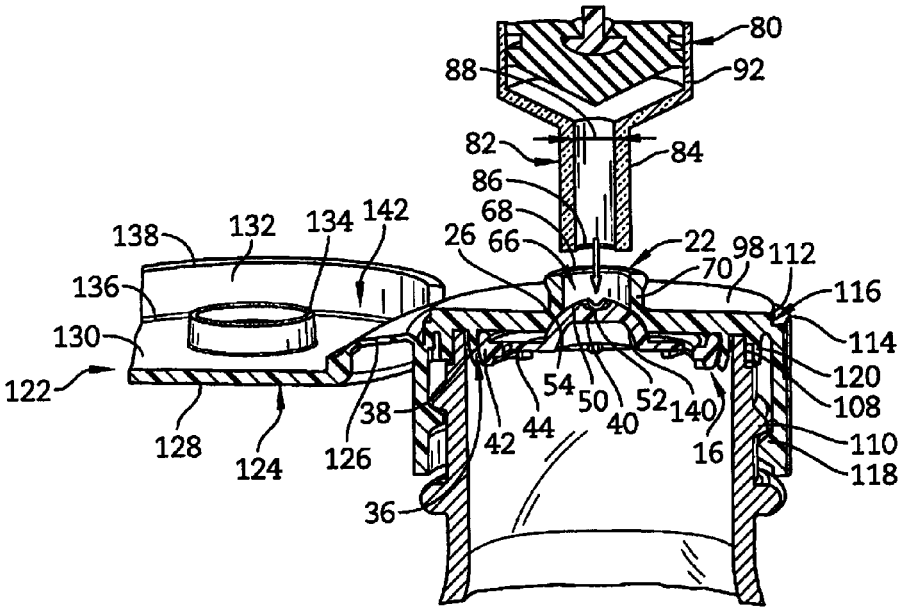
FIG. 3 is a sectional view of the package and syringe taken along line 3-3 of FIG. 1 showing the dosing dispenser before the fluid-transfer tip of the syringe is inserted into the syringe receiver and showing the valve assembly coupled to the body portion of the dosing dispenser, the valve assembling including a dome-shaped valve positioned within the opening of the syringe receiver to block the flow of fluid from the container.
Figure 4:
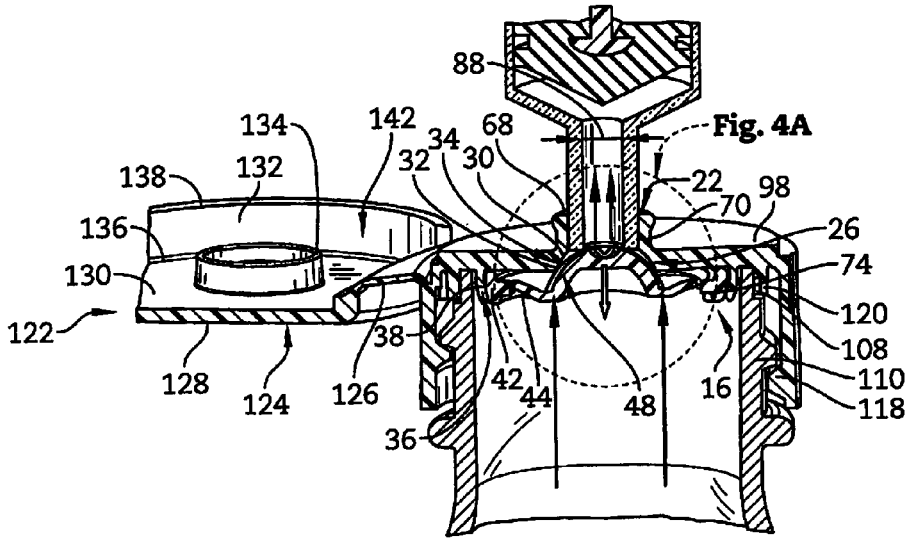
FIG. 4 is a partial sectional view of the package and syringe taken along line 3-3 of FIG. 1 showing the dosing dispenser after the fluid-transfer tip of the syringe has been inserted into the syringe receiver, and showing the fluid-transfer tip engaging the dome-shaped valve of the valve assembly to move the valve in a downward direction to unseat the valve to permit the flow of fluid into the fluid-transfer tip of the syringe, as indicated by the double arrows.

A package 10 in accordance with the present disclosure includes a container 12 and a dosing dispenser 14 coupled to a filler neck 100 of container 12, as shown, for example, in FIG. 1. Dosing dispenser 14 includes body portion 20 adapted to be mounted on container 12 and includes a flip-top cap 122 that is pivotably coupled to body portion 20 to conceal a syringe receiver 22. Syringe receiver 22 is configured to accept a fluid-transfer tip 82 of a syringe 80 to permit the dosing of liquid from container 12, as shown in FIGS. 3-4.

Figure 2:
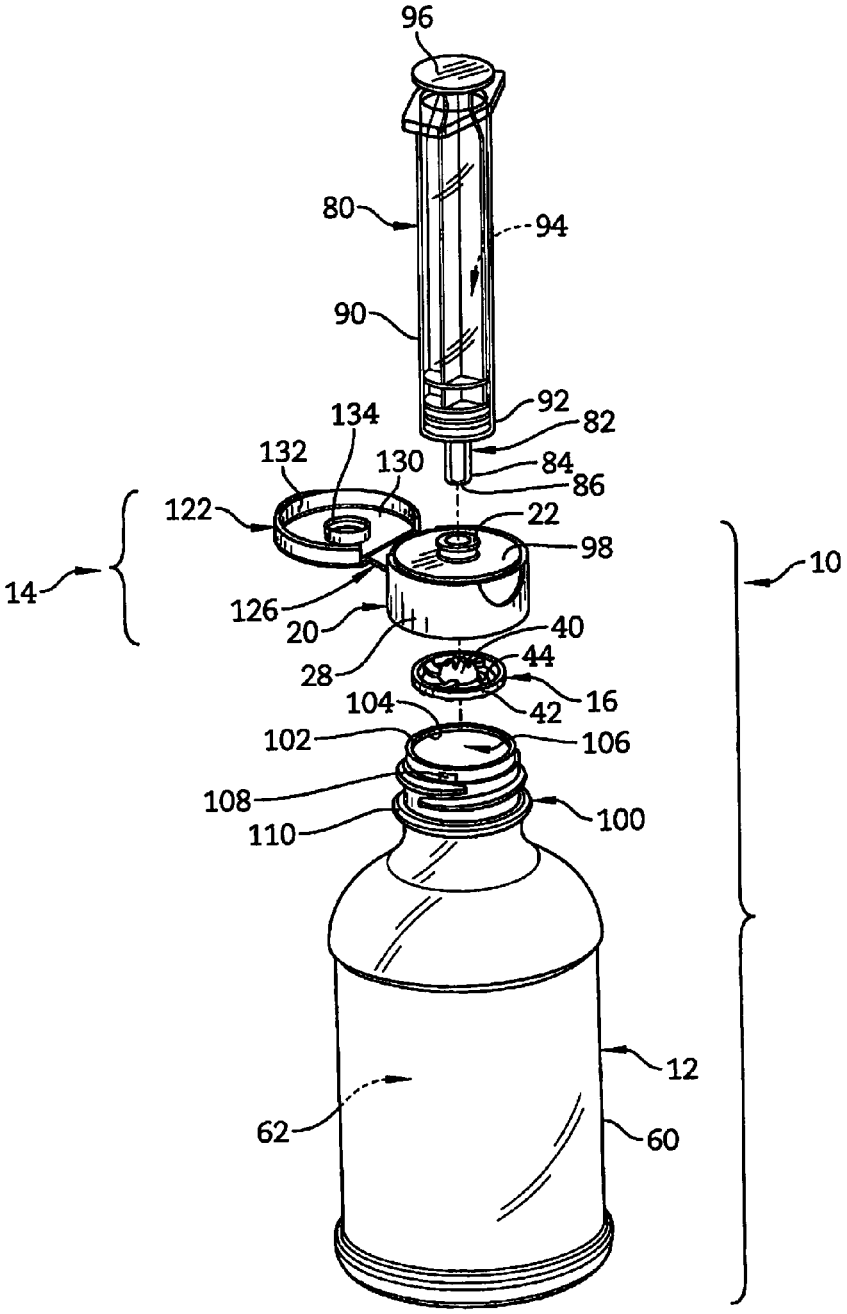
FIG. 2 is an exploded assembly view of the package of FIG. 1 along with the syringe for dosing fluid from the container and showing the dosing dispenser and a valve assembly that is configured to be coupled to the dosing dispenser to block the flow of fluid through the syringe receiver until the fluid-transfer tip of the syringe is inserted into the syringe receiver, as suggested in FIGS. 3-4*a;*
Figure 7:
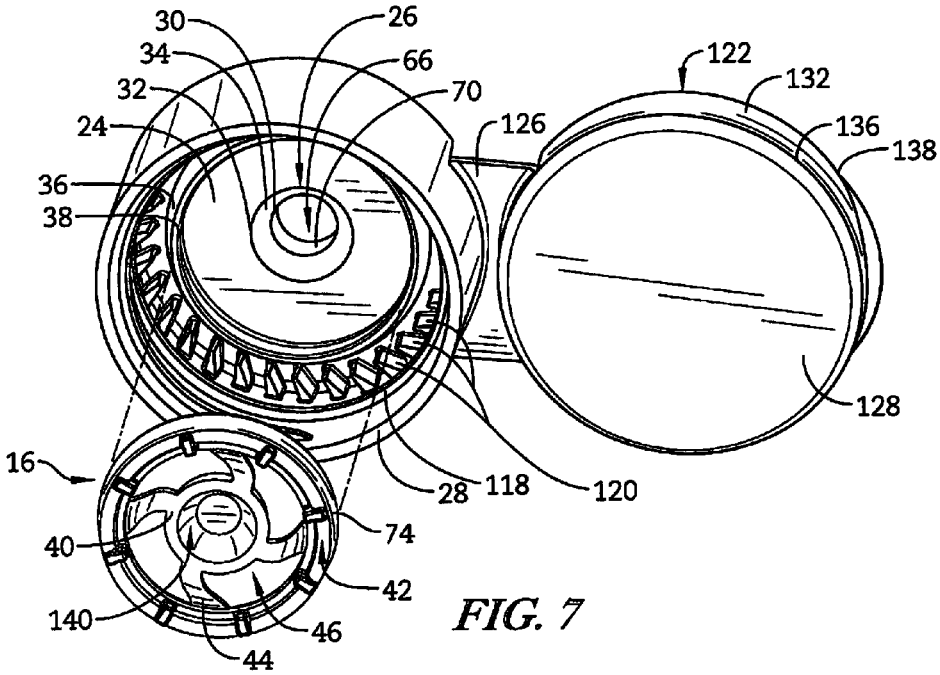
FIG. 7 is a perspective view of the underside of the dosing dispenser showing the valve assembly aligned to be inserted into the base portion of the dosing dispenser, the base portion including an inside surface that is provided with a downwardly depending annular mounting lock and a conical valve seat positioned radially inwardly from the mounting lock, the valve seat being configured to receive the valve of the valve assembly, and the mounting lock being adapted to lock the attachment ring to the body portion of the dosing dispenser when the valve assembly is installed into the dosing dispenser.
Figure 8:
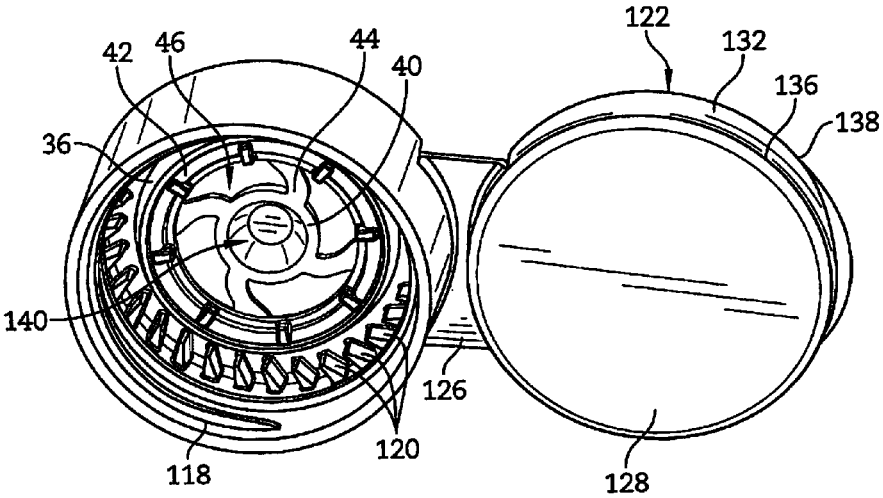
FIG. 8 is a perspective view similar to FIG. 7 showing the valve assembly attached to the inside surface of the dosing dispenser and showing an annular side wall having attachment threads and a series of locking blocks that extend radially inwardly to engage with corresponding locking lugs formed on the neck finish of the container, as suggested in FIG. 15 to lock the dosing dispenser to the container.

Body portion 20 of dosing dispenser 14 includes a top wall 98 and an annular side wall 28 depending from top wall 98, as shown in FIG. 2. Dosing dispenser 14 also includes a valve assembly 16 that is configured to be coupled to an inside surface 24 of top wall 98, as shown in FIGS. 7-8. Valve assembly 16 blocks the flow of liquid from container 12 through syringe receiver 22 unless fluid-transfer tip 82 of syringe 80 is inserted into syringe receiver 22, as shown in FIGS. 3-4.

Figure 4A:
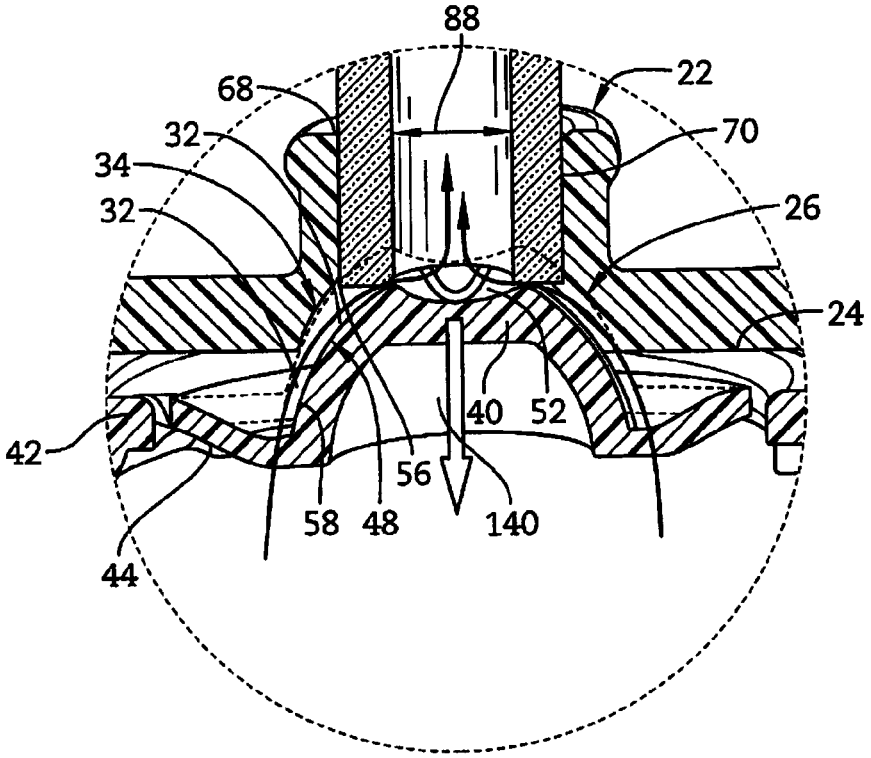
FIG. 4*a* is an enlarged view of FIG. 4 showing the movement of the valve of the valve assembly from a closed position, shown in phantom, where it is in sealing engagement with a valve seat of the syringe receiver to an opened, unseated position to permit the flow of fluid through flow channels of the valve into the fluid-transfer tip of the syringe as indicated by the arrows.
Figure 5:
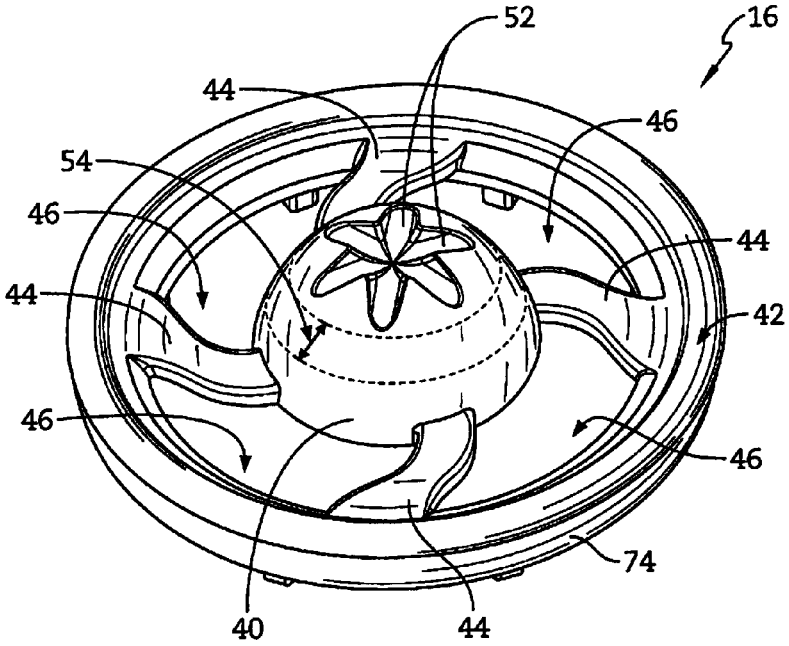
FIG. 5 is a perspective view of the top side of the valve assembly of FIGS. 2-4*a* showing the dome-shaped valve, an attachment ring and a series of flexible connectors coupling the valve to the attachment ring, the valve including a series of flow channels to permit the flow of fluid past the valve and into the fluid-transfer tip of the syringe, the flow channels being positioned above a sealing surface of the valve, and the attachment ring being configured to be coupled with the mounting lock of the body portion of the dosing dispenser, as suggested in FIGS. 7-8.
Figure 6:
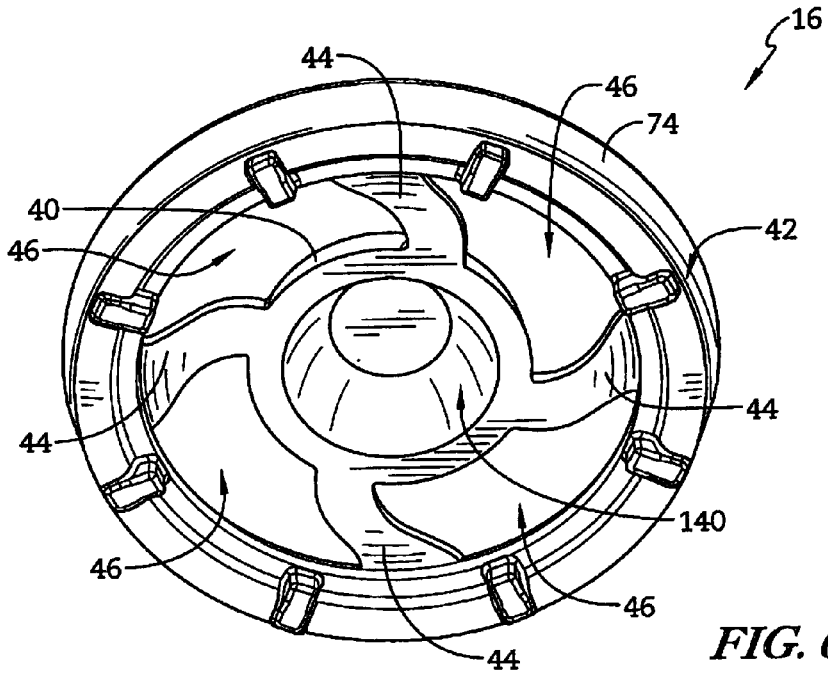
FIG. 6 is bottom perspective view of the valve assembly of FIG. 5 showing a concavity formed in the underside valve assembly.

Valve assembly 16 includes a valve 40, an attachment ring 42, and a series of flexible connectors 44 that couple valve 40 to attachment ring 42, as shown, for example, in FIGS. 5 and 6. Flexible connectors 44 are configured and arranged to bias valve 40 towards valve seat 26 to form a seal to block the transfer of fluid from container 12 through syringe receiver 22, as shown in FIG. 4A. While valve assembly 16 is illustratively made from a thermoplastic elastomeric material (TPE), it is contemplated that other elastomers or plastics materials can be used in accordance with the present disclosure.

Valve 40 of valve assembly 16 is a dome-shaped structure that includes a series of flow channels 52 and a sealing zone 54, as shown, for example, in FIG. 5. Valve 40 is configured to seal with a valve seat 26 formed on an inside surface 24 of body portion 20, as shown, for example, in FIG. 7. Valve 40 is also formed to include a concavity 140 on the underside of valve 40 to permit deformation of valve 40 when in contact with valve seat 26 of body portion 20, as shown in FIG. 6. While a dome-shaped structure is used, it is within the scope of the present disclosure to make valve 40 in various shapes to accomplish the desired sealing result, such as a conical or pyramidal shape, for example.

Flow channels 52 of valve 40 provide conduits to permit fluid to flow from container 12 into an inlet orifice 86 of fluid transfer tip 82 of syringe 80, when valve 40 is in an opened position and plunger 96 is drawn rearward, as shown in FIGS. 4-4*a*. Sealing region 54 of valve 40 is an area that is in contact with valve seat 26 when valve 40 is biased to a closed position to create a liquid-tight seal. Flow channels 52 are positioned outside of sealing region 54 so that no fluid can pass through sealing region 54 when valve 40 is in a closed position. When valve assembly 16 is coupled with dosing dispenser 14, valve 40 sealably engages with valve seat 26 via sealing region 54.

Attachment ring 42 of valve assembly 16 is configured to be coupled to top wall 98 of body portion 20, as shown, for example, in FIGS. 7 and 8. Inside surface 24 of body portion 20 includes an outwardly extending mounting lock 36 that is used to secure attachment ring 42 to base portion 20. Mounting lock 36 is annular and reduces in diameter as it extends away from inside surface 24 of body portion 20. Mounting lock 36 is configured to receive an outer surface 74 of attachment ring 42 to hold attachment ring 42 in position against top wall 98 of body portion 20. When attachment ring 42 is secured to mounting lock 36, flexible connectors 44 bias valve 40 against valve seat 26.

Flexible connectors 44 are adapted to connect attachment ring 42 to valve 40 and also bias valve 40 against valve seat 26 when no outside forces are applied to valve 40, as shown in FIGS. 5 and 6. Flexible connectors 44 are generally equally spaced around valve 40 to provide uniform biasing forces to valve 40 so that movement of valve 40 with respect to valve seat 26 is generally linear when force by a syringe is applied. When force is applied to valve 40 by syringe 80, flexible connectors 44 yield to allow valve 40 to separate from seat 26 to permit the flow of fluid material 64 between valve 40 and valve seat 26. Flexible connectors 44 of valve assembly 16 form a series of flow apertures 46 to allow for the flow of fluid material 64 through flow apertures 46, as shown in FIG. 5.

Figure 9:
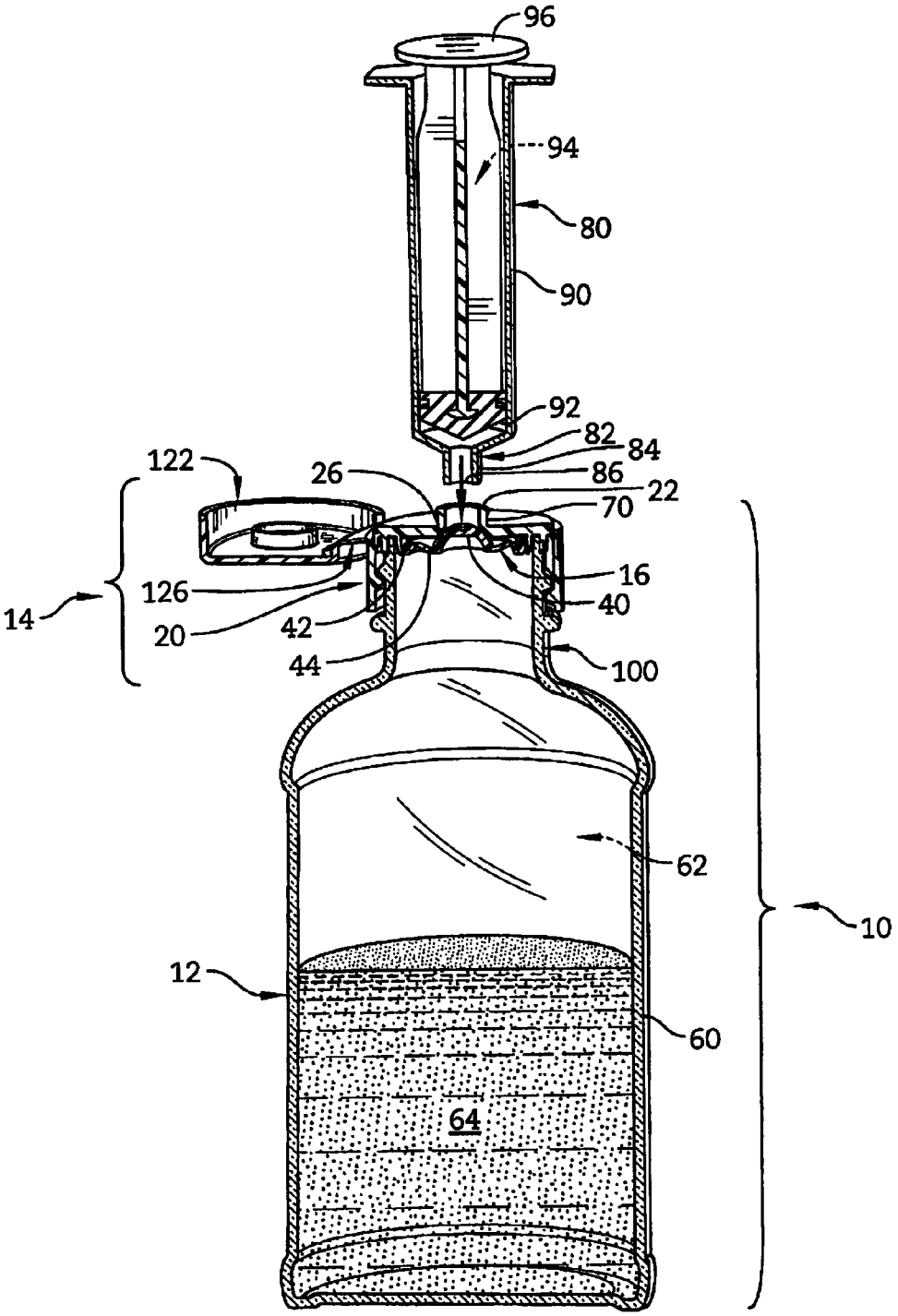
FIG. 9 is a sectional view of the package and syringe taken along line 9-9 of FIG. 1, showing the syringe moving in the direction of the arrow to allow insertion of the fluid-transfer tip into the syringe receiver of the dosing dispenser, the syringe including a plunger movable in a stationary tube relative to an inlet-outlet orifice formed in the fluid-transfer tip of the syringe, and the fluid-transfer tip being provided at a lower end of the stationary tube.
Figure 10:
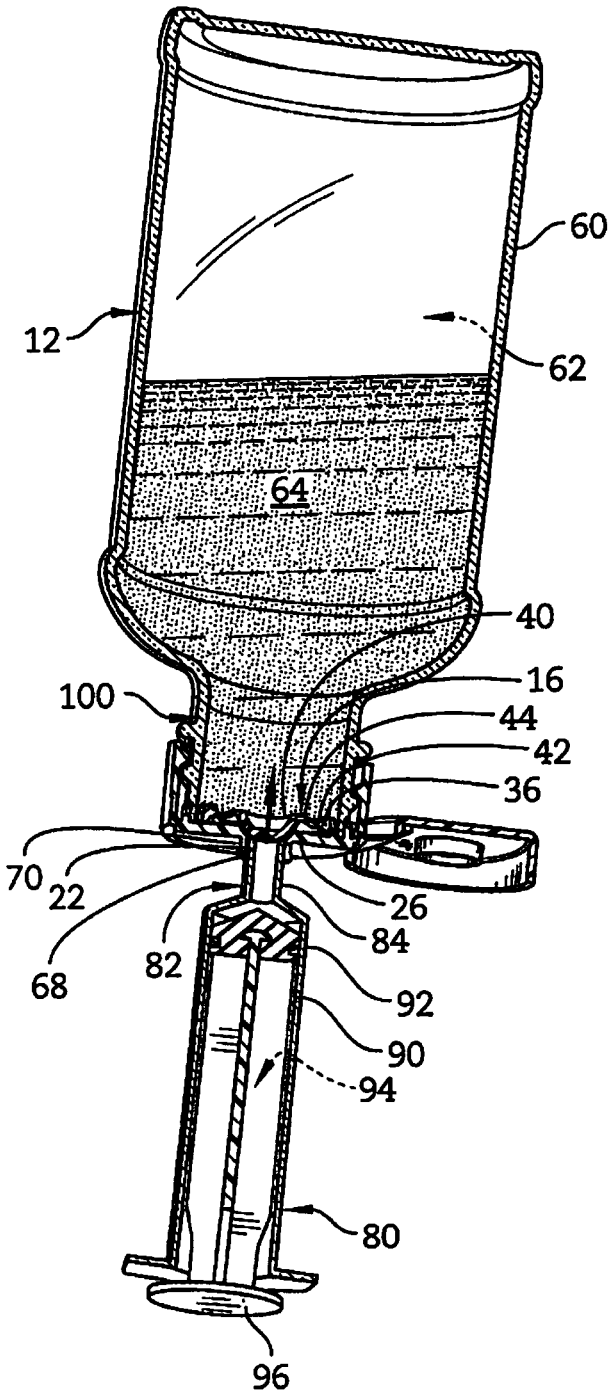
FIG. 10 is a sectional view similar to FIG. 9 showing the container and dosing dispenser in an inverted position and the fluid-transfer tip of the syringe being inserted into the syringe receiver of the dosing dispenser to move the valve of the valve assembly to an opened position to permit the dosing of fluid from the container.
Figure 11:
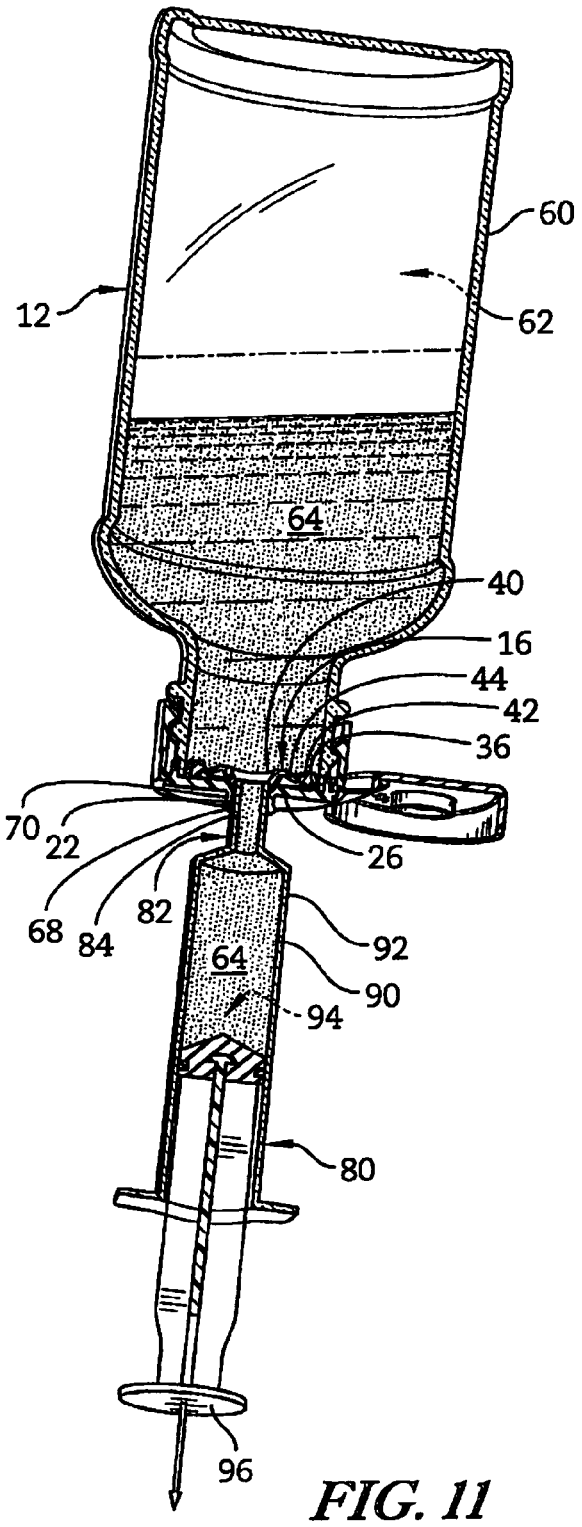
FIG. 11 is a sectional view similar to FIGS. 9-10 showing downward movement of the plunger in the syringe relative to the stationary tube to draw fluid material from the container, past the valve, and into a fluid-storage chamber of the stationary tube included in the syringe through fluid-transfer tip as it engages with the syringe receiver and valve of the dosing dispenser.

Syringe receiver 22 of dosing dispenser 14 is adapted to mate with syringe 80 or similar fluid exporting instrument to allow for the dosing of fluid material 64 from interior region 62 of a fluid-storage body 60, as shown, for example, in FIGS. 9-11. In particular, syringe receiver 22 is formed to include an exterior opening 68 for receiving fluid-transfer tip 82 of syringe 80, as shown in FIGS. 3-4. Syringe receiver 22 forms a discharge port means 66 for allowing fluid material 64 to flow from interior region 62 of fluid-storage body 60, through syringe receiver 22, and into syringe 80.

Inside surface 24 of body portion 20 includes valve seat 26, as shown, for example, in FIGS. 4 and 7. Valve seat 26 lies in vertical alignment with syringe receiver 22, which includes an interior opening 68 that lies near valve seat 26. Valve seat 26 is conically shaped and tapers from an inner diameter 30 that abuts syringe receiver 22 to an outer diameter 32 that abuts inside surface 24. Valve seat 26 also includes a second sealing face 34 that extends from inner diameter 30 to outer diameter 32, second sealing face 34 is configured to engage with first sealing face 48 of valve 40 when valve 40 is in a closed position.

Top wall 98 of body portion 20 includes an annular vertical wall 112. Annular vertical wall 112 is positioned to lie near and substantially perpendicular to an inner top edge 114 of annular side wall 28 of body portion 20. Annular vertical wall 112 and inner top edge 114 cooperate to form an annular groove 116. When dosing dispenser 14 is coupled to container 12, annual flange 38 is forced into filler neck passageway 106 and abuts against an inside lip 104 of mouth 102 to provide frictional engagement with filler neck 100.

Dosing dispenser 14 also include includes a hinge 126 coupled to body portion 20 and a flip-top cap 122 depending from hinge 126. Dosing dispenser 14 is adapted to seal open mouth 102 in container 12 to allow for selected removal of fluid material 64 from container 12. Hinge 126 is coupled to body portion 20 to support flip-top cap 122 for movement relative to body portion 20.

Flip-top cap 122 of dosing dispenser 14 includes a movable lid 124 formed to include an inner chamber 142, as shown, for example, in FIGS. 3 and 4. Movable lid 124 includes a cap top wall 128 and an annular cap side wall 132 depending from cap top wall 128. Annular cap side wall 132 is adapted to be received on body portion 20 when flip-top cap 122 is in a closed position on body portion 20. Annular groove 116 of body portion 20 is adapted to accept annular cap side wall 132 of movable lid 124 when flip-top cap 122 is in the closed position on body portion 20.

Container 12 includes a fluid-storage body 60 formed to include an interior region 62 and filler neck 100 having a mouth 102 opening into a filler-neck passageway 106 communicating with interior region 62 as shown, for example, in FIGS. 1 and 2.

Top wall 98 of movable lid 124 includes a cap inside surface 130 having a plug 134 as shown, for example, in FIG. 1. Plug 134 is adapted to seal syringe receiver 22 when flip-top cap 122 is in the closed position on body portion 20. Annular cap side wall 132 of movable lid 124 includes a first edge 136 depending from top cap wall 128 and a second edge second edge 138 that is spaced apart from first edge 136. Second edge 138 of annular cap side wall 132 is adapted to be coupled with annular groove 116 of body portion 20 when flip-top cap 122 is in the closed position on body portion 20.

Syringe 80 includes a tube 90 formed to include a fluid-storage chamber 94 and fluid-transfer tip 82 coupled to a lower end of stationary tube 90 to cause a tip passageway 84 formed in fluid-transfer tip 82 to lie in fluid communication with fluid-storage chamber 94. Fluid-transfer tip 82 also is formed to include an inlet-outlet orifice 86 opening into tip passageway 84 as suggested in FIGS. 3 and 4. Syringe 80 also includes a plunger 96 mounted for movement in fluid-storage chamber 94 relative to stationary tube 90 to generate a suction force sufficient to draw fluid material 64 from interior region 62 in fluid-storage body into fluid-storage chamber 94 via tubular sleeve 70 in syringe receiver 22 and tip passageway 84 in fluid-transfer tip 82 in syringe 80, as suggested in FIGS. 9-11.

Dosing dispenser 14 is configured to mate with filler neck 100 using any suitable means to close open mouth 102 and is further configured to be lockably retained on filler neck 100 once it is mated on filler neck 100. Filler neck 100 includes one or more engagement lugs 108 that project in a radially outwardly extending direction away from interior region 62 of fluid-storage body 60. Dosing dispenser 14 includes inside surface 24 with one or more locking retention lugs 120 that project in a radially inwardly extending direction toward interior region 62 of fluid-storage body 60. When dosing dispenser 14 is mated onto filler neck 100, locking retention lugs 120 and engagement lugs 108 engage each other, causing dosing dispenser 14 to be irremovable from fluid-storage body 60.

A valve assembly 210 in accordance with another embodiment of the present disclosure is shown, for example, in FIGS. 12-14*a*. Valve assembly 210 functions similar to valve assembly 16 of FIGS. 1-11 but includes a different configuration for biasing valve 212 towards valve seat 26. Valve assembly 210 includes a cantilever arm 218 that connects valve 212 to attachment ring 216.

Figure 12:
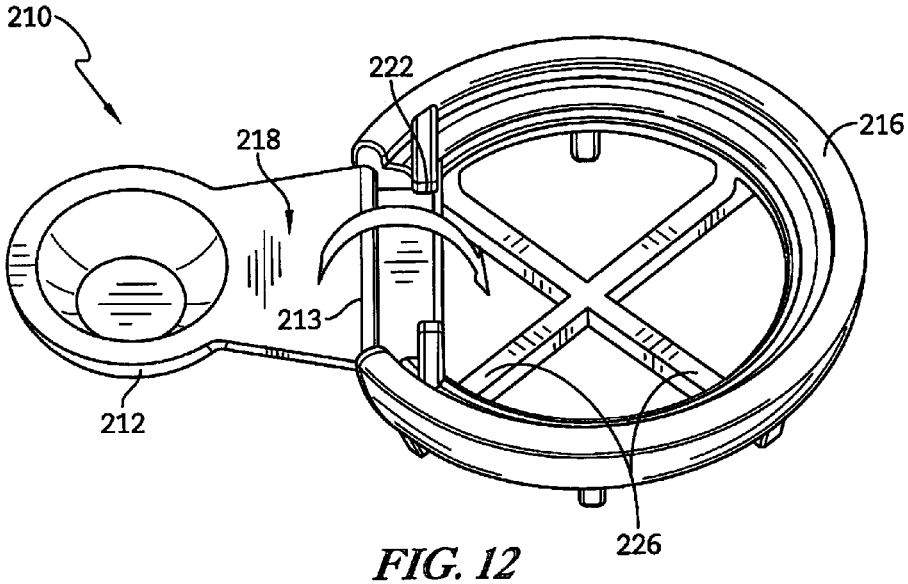
FIG. 12 is a perspective view of another embodiment of the valve assembly of the present disclosure, showing the valve assembly in a molded position and having a valve, an attachment ring, and a cantilever arm connecting the valve to the attachment ring, the cantilever arm being configured to be rotated about an axis to position the valve within the attachment ring, as suggested in FIG. 13.
Figure 13:
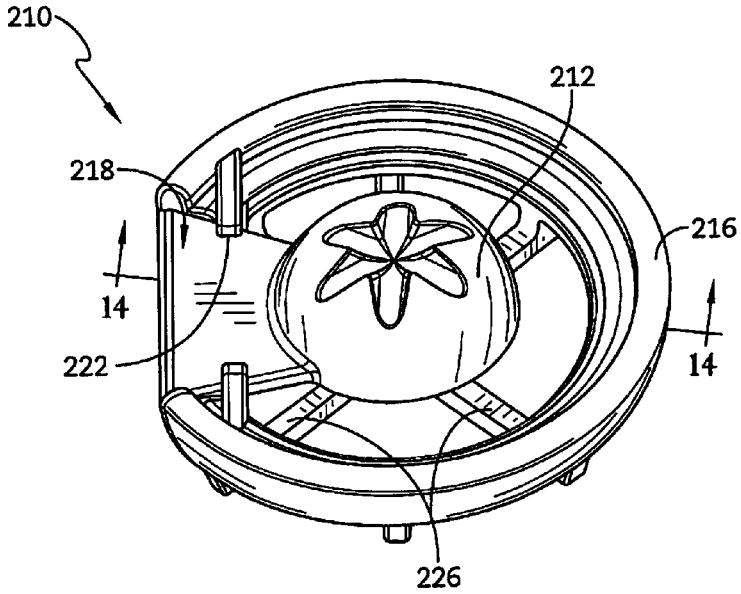
FIG. 13 is another perspective view of FIG. 12 showing the valve assembly in the in-use position with the valve positioned within the attachment ring and the cantilever arm being locked in a position by use of a pair of retainers that engage and secure the cantilever arm, and the cantilever arm being configured to deflect downwardly in response to downward force applied to the valve by the fluid-transfer tip of the syringe.

Cantilever arm 218 of valve assembly 210 attaches to valve 212 and provides a biasing force to bias valve 212 against valve seat 26. During the manufacture of valve assembly 210, cantilever arm 218 and valve 212 are molded to the outside of attachment ring 216, as shown in FIG. 12. During finishing, cantilever arm 218 and valve 212 are pivoted about axis 213, over into the center of attachment ring 216 and snapped into retainers 222, as shown in FIG. 13.

Figure 14:
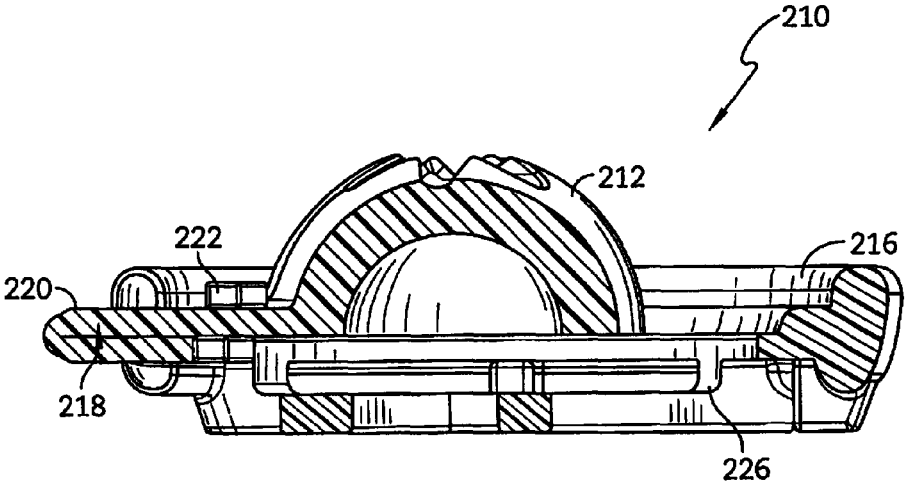
FIG. 14 is a sectional view taken along line 14-14 of FIG. 13 showing the position of the valve with respect to the attachment ring prior to a force being applied to the valve by the fluid-transfer tip of the syringe.
Figure 14A:
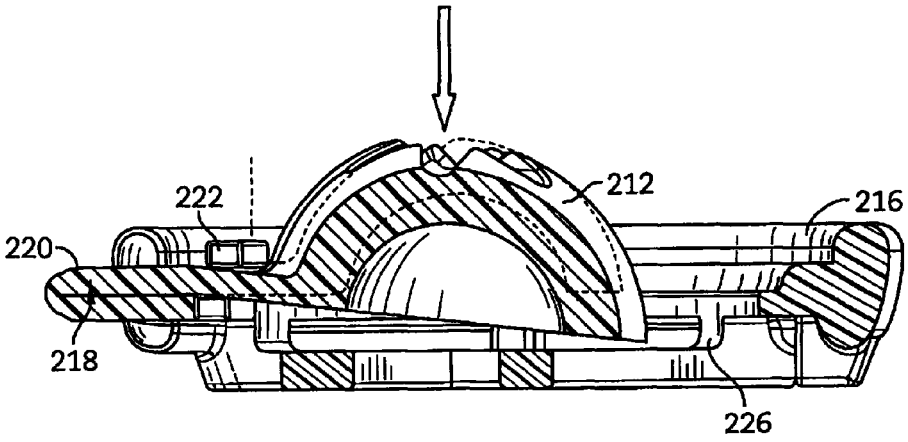
FIG. 14*a* is a sectional view similar to FIG. 14 showing the downward deflection of the valve and cantilever arm with respect to the attachment ring when a force is applied to the valve by the fluid-transfer tip of the syringe.
Figure 15:
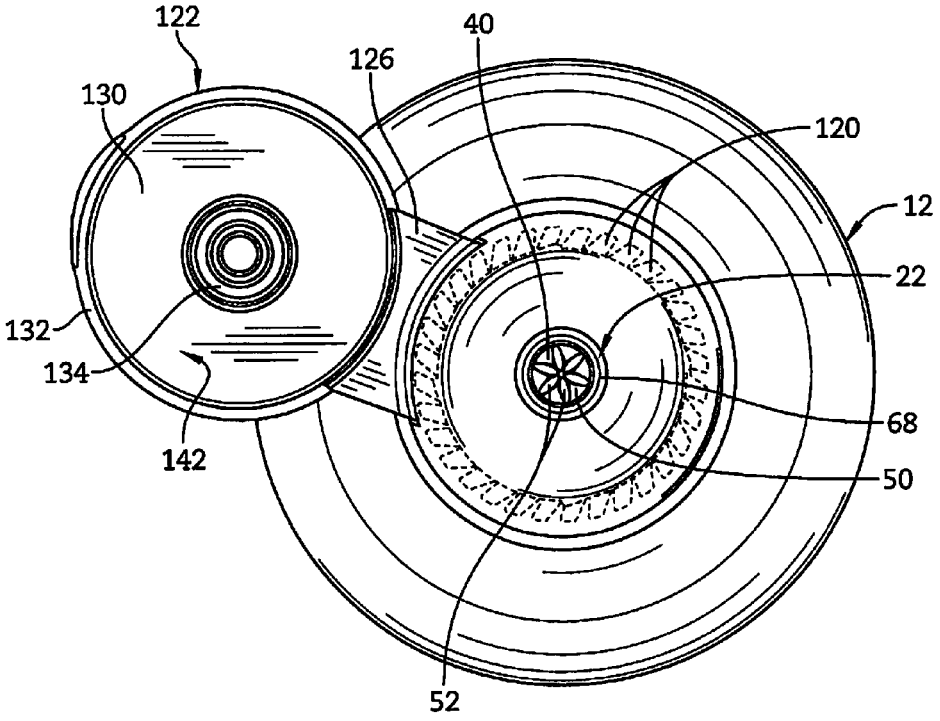
FIG. 15 is a top view of the container and dosing dispenser showing the flow channels of the valve in line with the syringe receiver and also showing the series of radially extending locking blocks engaging locking lugs formed on the neck finish of the container.

Cantilever arm 218 of valve assembly 210 snaps into retainers 222 to secure cantilever arm 218 and valve 212 in an in-use position. Once in position, the portion of cantilever arm 218 that extends between retainers 222 and valve 212 flexes to bias valve 212 against valve seat 26 when in use, as shown in FIGS. 14 and 14*a*. Valve assembly 210 includes one or more rigidity members 226 that span across attachment ring 216, below valve 212. Rigidity members 226 provide structural support to valve assembly 210.

Valve assembly 16 includes a valve 40 that provides a seal with an valve seat 26 included in an inside surface 24 of body portion 20 of dosing dispenser 14 as seen in FIGS. 3 and 4. This seal is broken when a force is applied to valve 40 in the direction of an interior region 62 of a fluid-storage body 60 of container 12, allowing for fluid material 64 to flow from interior region 62 through syringe receiver 22 into a syringe 80. In particular, syringe receiver 22 is adapted to mate with syringe 80 to allow a user to transfer fluid material 64 from container 12 into syringe 80 through valve assembly 16 and syringe receiver 22, as suggested in FIGS. 9-11. A fluid-transfer tip 82 of syringe 80 applies force on valve 40 in the direction of interior region 62, breaking the seal to allow fluid to flow into syringe 80.

The invention claimed is:

1. A dosing dispenser for dosing a liquid into a syringe comprising a body portion including a top wall formed to include a syringe receiver, the body portion adapted to mate with a discharge outlet formed on a container, and an annular side wall appended to the top wall and arranged to extend downwardly and away from the top wall and to cooperate with the top wall to form an interior region, and a valve assembly positioned within the interior region of the body portion, the valve assembly including a valve with a dome-shaped surface and a biasing member coupled to the valve, the biasing member configured to bias the valve to a closed position to seal the syringe receiver to prevent the flow of liquid, wherein insertion of a portion of the syringe into the syringe receiver causes the valve to move from the closed position to an opened position to permit the flow of liquid from the container and into the syringe and removal of the syringe from the syringe receiver causes the valve to return to the closed position to prevent the further release of liquid from the container, wherein the dome-shaped surface of the valve seals the syringe receiver.

2. The dosing dispenser of claim 1, wherein the top wall is formed to include a valve seat that is configured to accept at least a portion of the valve from the valve assembly.

3. The dosing dispenser of claim 2, wherein the valve includes a sealing region that sealingly engages with the valve seat to form a seal to prevent the unwanted discharge of liquid from syringe receiver.

4. The dosing dispenser of claim 2, wherein the valve includes a domed upper surface and a concave lower surface, the valve being formed from a deformable material to permit the valve to conform to the shape of the valve seat.

5. The dosing dispenser of claim 2, wherein the valve assembly includes an assembly ring that is configured to be coupled to the top wall of the body portion to retain the valve assembly to the body portion.

6. The dosing dispenser of claim 5, wherein the top wall includes an annular mounting lock that is configured to secure an assembly ring to the top wall of the dosing dispenser.

7. The dosing dispenser of claim 6, wherein the mounting lock reduces in diameter as it extends away from the inside surface of the top wall and is configured to receive an outer surface of the attachment ring to hold the attachment ring in position against the top wall of the body portion.

8. The dosing dispenser of claim 5, wherein the biasing member includes a series of elongated flexible connectors that extend radially from the valve to the attachment ring and are arranged to permit axial movement of the valve.

9. The dosing dispenser of claim 1, wherein the valve includes a domed upper surface having an annular sealing region.

10. The dosing dispenser of claim 9, wherein the valve includes a sealing region and at least one flow channel that is configured to permit fluid to flow from the container and into the syringe when the valve is in the opened position.

11. The dosing dispenser of claim 10, wherein the at least one flow channel does not extend through the sealing region of the valve.

12. A dosing dispenser for dosing a liquid into a syringe comprising a body portion including a top wall formed to include a syringe receiver, the body portion adapted to mate with a discharge outlet formed on a container, and an annular side wall appended to the top wall and arranged to extend downwardly and away from the top wall and to cooperate with the top wall to form an interior region, and a valve assembly positioned within the interior region of the body portion, the valve assembly including a valve and a biasing member coupled to the valve, the biasing member configured to bias the valve to a closed position to seal the syringe receiver to prevent the flow of liquid, wherein insertion of a portion of the syringe into the syringe receiver causes the valve to move from the closed position to an opened position to permit the flow of liquid from the container and into the syringe and removal of the syringe from the syringe receiver causes the valve to return to the closed position to prevent the further release of liquid from the container, wherein the valve assembly includes an attachment ring and the biasing member includes a cantilever arm that couples the valve to the attachment ring.

13. The dosing dispenser of claim 12, wherein the position of the cantilever arm is retained by at least one retainer so that the valve is positioned radially inwardly of the attachment ring.

14. The dosing dispenser of claim 12, wherein when the valve assembly is in a molded position, the cantilever arm and the valve are positioned radially outwardly from the attachment ring.

15. The dosing dispenser of claim 14, wherein when the valve assembly is in a use position, the cantilever arm and valve are positioned radially inwardly from the attachment ring.

16. The dosing dispenser of claim 12, wherein the cantilever arm and valve are pivotable about an arc of the attachment ring.

17. A dosing dispenser for dosing a liquid into a syringe comprising a body portion including a top wall formed to include a syringe receiver, the body portion adapted to mate with a discharge outlet formed on a container, and an annular side wall appended to the top wall and arranged to extend downwardly and away from the top wall and to cooperate with the top wall to form an interior region, a valve assembly positioned within the interior region of the body portion, the valve assembly including an attachment ring, a valve with a dome-shaped surface, and at least one biasing member that is adapted to couple the valve to the attachment ring, the biasing member configured to bias the valve to a closed position to seal the syringe receiver to prevent the flow of liquid, the top wall including a mounting lock that is configured to secure the attachment ring to top wall of dosing dispenser, and wherein insertion of a portion of the syringe into the syringe receiver causes the valve to move from the closed position to an opened position to permit the flow of liquid from the container and into the syringe and removal of the syringe from the syringe receiver causes the valve to return to the closed position, wherein the dome-shaped surface of the valve seals the syringe receiver to prevent the further release of liquid from the container.

18. The dosing dispenser of claim 17, wherein the at least one biasing member is in the form of a series of elongated flexible connectors that extend radially from the valve to the attachment ring and are arranged to permit axial movement of the valve.

19. The dosing dispenser of claim 17, wherein the valve includes a sealing region and at least one flow channel that is configured to permit fluid to flow from the container and into the syringe when the valve is in the opened position.

20. The dosing dispenser of claim 19, wherein the at least one flow channel does not extend through the sealing region of the valve.

21. The dosing dispenser of claim 19, wherein the mounting lock reduces in diameter as it extends away from an inside surface of the top wall and is configured to receive an outer surface of the attachment ring to hold the attachment ring in position against the top wall of the body portion.

22. The dosing dispenser of claim 17, wherein the dome-shaped valve includes a plurality of channels configured to permit fluid to flow from the container and into the syringe when the valve is in the opened position.

23. The dosing dispenser of claim 22, wherein the plurality of channels are radially inside of and do not extend through the sealing region of the valve.

* * * * *